US006591797B2

(12) United States Patent
Entzminger

(10) Patent No.: US 6,591,797 B2
(45) Date of Patent: Jul. 15, 2003

(54) VARIABLE FULCRUM ROCKER ARM

(76) Inventor: William W. Entzminger, P.O. Box 835067, Richardson, TX (US) 75083

( * ) Notice: Subject to any disclaimer, the term of this patent is extended or adjusted under 35 U.S.C. 154(b) by 0 days.

(21) Appl. No.: 09/816,868

(22) Filed: Mar. 23, 2001

(65) Prior Publication Data

US 2002/0134329 A1 Sep. 26, 2002

(51) Int. Cl.[7] ..... F01L 1/34
(52) U.S. Cl. ..... 123/90.16; 123/90.39
(58) Field of Search ..... 123/90.15, 90.16, 123/90.39, 90.41; 74/519, 559

(56) References Cited

U.S. PATENT DOCUMENTS 4,721,007 A 1/1988 Entzminger ..... 74/522
4,841,799 A 6/1989 Entzminger ..... 74/522

*Primary Examiner*—Weilun Lo
(74) *Attorney, Agent, or Firm*—Dennis T. Griggs; Scott T. Griggs

(57) ABSTRACT

A variable ratio rocker arm is provided for use in combination with the valve stem and push rod of an internal combustion engine. The rocker arm has a toothed rack. A fulcrum rod is provided with a toothed sector. A stationary support member has a rod seat. The fulcrum rod toothed sector engages the toothed rack of the rocker arm and the rod seat of the stationary support shaft. An operating arm is coupled to the fulcrum rod for simultaneously rotating and translating the fulcrum rod along the toothed rack of the rocker arm and the rod seat of the stationary support shaft. The operating arm causes the fulcrum rod to rotate and translate along the mating toothing from one point of pivotal engagement, corresponding to a first engine operating condition, to another point of pivotal engagement, corresponding to a second engine operating condition.

4 Claims, 3 Drawing Sheets

14
30
62
64
34
36
82
32
16
40
38
42
28
26
44
24

VARIABLE FULCRUM ROCKER ARM

BACKGROUND OF THE INVENTION

The present invention relates to a pivoting lever arm mechanism utilized in transmitting reciprocal linear motion and/or force by pivoting about a fulcrum pivot point intermediate the ends of the lever arm, and more particularly to a lever arm of this sort having the capability of varying the ratio of lengths of moment arms from respective ends of the lever arm about the fulcrum pivot point there between.

The instant invention may be utilized in mechanical devices wherein reciprocal linear motion is to be transmitted (1) in a different direction, (2) in a specifically defined ratio of distances of linear movements, or (3) in instances wherein the linear motion causing movement of the lever arm is provided directly by the rotational movement of a cam device having one or more lobes thereon, or wherein the linear motion is provided by a lever, piston or other power input device, the effect of which is to reciprocally urge the end of the lever arm in an arcing movement pattern about the fulcrum pivot point.

In the field of overhead valve internal combustion engines, valve rocker arms have been constrained to reciprocal rotational movement about a fixed fulcrum point. Because this fulcrum point is fixed relative to the fixed location of the engine valves and camshaft and/or pushrods, the amount of valve opening is constant throughout the entire range of engine speeds and engine load conditions. Therefore, it has been considered highly desirable to provide a means whereby the amount of valve opening may be varied and controlled during engine operation in response to variations in engine load demand. Specifically, it has been desirable to provide a device for permitting the selective increase in valve opening amount in relation to increased engine revolutions per minute (hereinafter "RPM") and additionally, decrease the amount of valve opening at engine speeds below the optimum power peak point designed into the specific engine camshaft.

At engine speeds below this optimum power peak, a decrease in amount of valve opening proportional to RPM prevents the camshaft from "loading" and, therefore, provides greater torque at engine speeds in this below peak range. In a similar manner, at engine speeds above this power peak, an increase in amount of valve opening proportional to RPM provides greater power output in this above power peak range. The end result is to effectively broaden the optimum power peak curve, by effecting a power peak that actually shifts as a function of valve opening, which is related to actual engine RPM. In this manner, increased fuel economy is obtained at all engine speeds because the actual amount of valve opening is optimum across essentially the entire speed range for the specific camshaft design.

The present invention has specific application to internal combustion engines, wherein the lever arm takes the form of the rocker arm on overhead valve type engines and the reciprocating linear motion is transmitted from a rotating cam either directly to the rocker arm or indirectly to the rocker arm through a pushrod member. The rocker arm pivots about a fulcrum point so that the reciprocating arcing motion transmitted to one end of the rocker arm is passed therethrough, via oscillatory rotation about the fulcrum pivot point, to the other end of the rocker arm which engages the stem of a valve situated within the engine head to thereby selectively open the valve to permit intake and exhaust gases to pass there around.

The present invention provides the means whereby the ratio of the distance of reciprocal arcing movement of the end of the rocker arm that engages the camshaft or pushrod relative to the fulcrum pivot point, to the distance of arcing movement of the end of the rocker arm that engages the valve stem may be varied in response to variations in engine load requirements while the engine is operating.

It should be apparent that the present invention has applications other than rocker arms for internal combustion engines. However, for purposes of explanation, it will be described and explained with reference to internal combustion engine valve opening mechanisms.

BRIEF SUMMARY OF THE INVENTION

The present invention provides a novel variable fulcrum rocker arm mechanism that may be used with an overhead valve type internal combustion engine for shifting the fulcrum point about which the lever arm pivots relative to the opposing ends of the lever arm. The invention will be described in terms of a valve opening rocker arm which is retained in place relative to the position of the valve stem and pushrod, or point of contact of a camshaft acting on the rocker arm. The rocker arm incorporates an essentially elongate through aperture through which the fulcrum rod is functionally positioned, so that the rocker arm may pivot about the fulcrum rod.

The rocker arm utilizes a shaft with underbelly splines that mate with corresponding splines in the lower trunnion section of specially designed rocker arms. Specific positioning of this splined shaft changes the fulcrum point. The movable fulcrum enables a change of the relative arc length of travel of each end of the rocker arm. In this manner, the amount of valve opening can be altered and controlled for any given constant amount of pushrod reciprocal movement or camshaft lift.

BRIEF DESCRIPTION OF THE DRAWING

The accompanying drawing is incorporated into and forms a part of the specification to illustrate the preferred embodiments of the present invention. Various advantages and features of the invention will be understood from the following detailed description taken in connection with the appended claims and with reference to the attached drawing figures in which:

DETAILED DESCRIPTION OF THE INVENTION

Figure 1:
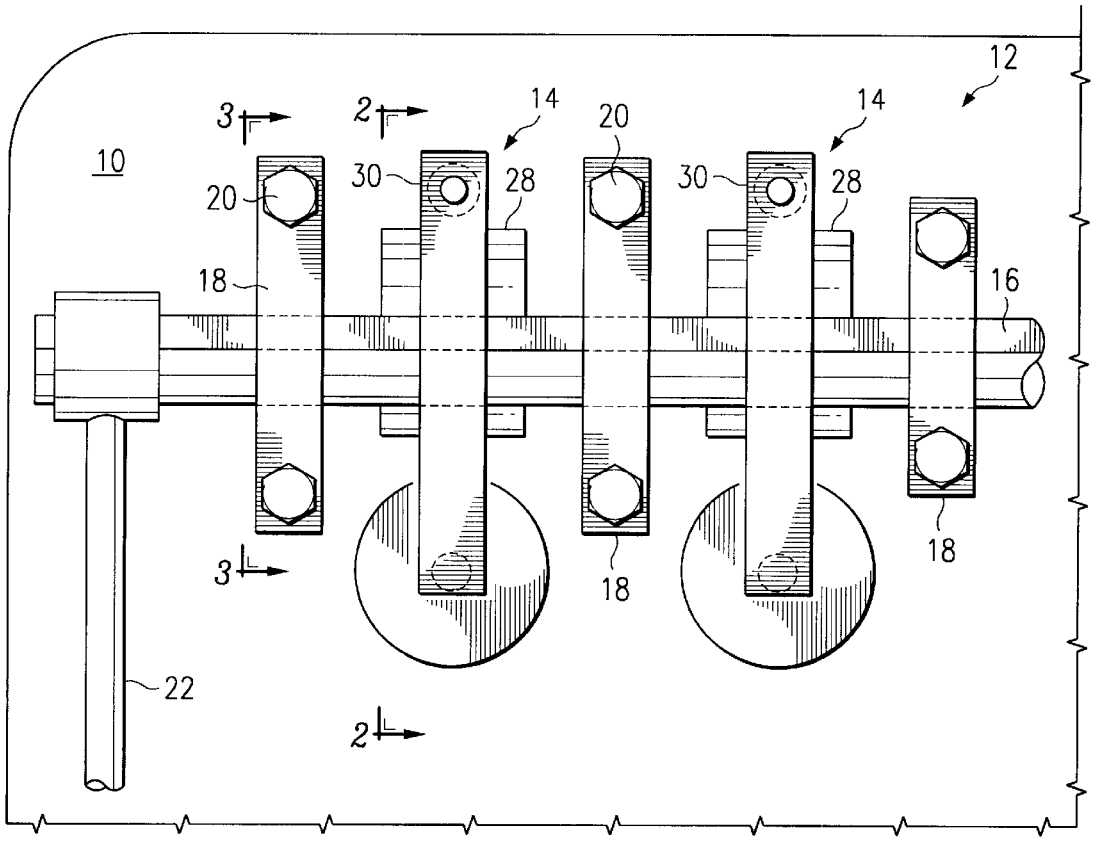
FIG. 1 is a top view of a representative overhead valve head of an internal combustion engine showing the valve and rocker arm assembly mechanism utilizing the present invention in functional position thereon.

Preferred embodiments of the invention will now be described with reference to examples of how the invention can best be made and used. Like reference numerals are used throughout the description and several views of the drawing to indicate like or corresponding parts.

Turning now to the drawings, wherein like parts are indicated throughout the specification and drawings with the same reference numerals, and more specifically to FIG. 1, a typical valve head 10 of an internal combustion engine is shown in a top view. A portion of a variable fulcrum rocker arm assembly mechanism incorporating the concept of the variable fulcrum lever arm mechanism of the present invention is shown, generally illustrated at 12, functionally mounted on top of the head 10. For purposes of simplicity in explanation, the instant invention will be described in terms of its application as a rocker arm assembly utilized in a conventional overhead valve type internal combustion engine. However, it is to be understood that the variable ratio level arm mechanism of the instant invention is not to be so limited in its application and use, but rather may be equally well adapted to use in any mechanical application wherein it is desirable or advantageous to utilize the inventive concept of varying the fulcrum point in a pivoting lever arrangement to thereby alter the ratio of distances of linear travel of connecting rods or the like associated therewith.

As utilized in an internal combustion engine, the variable fulcrum lever arm mechanism of the present invention takes the form of rocker arm 14 mounted for pivotal movement on a fulcrum rod 16. The fulcrum rod 16 is maintained in a spaced relationship relative to the valve head 10 by a stationary shaft support 18, hard mounted to the valve head by bolts 20 or other similar mounting apparatus. The fulcrum rod 16 also includes an operating lever 22 or other similar device for rotating the fulcrum rod 16 in response to changing load conditions on the engine, as will be explained in greater detail hereinbelow.

Figure 2:
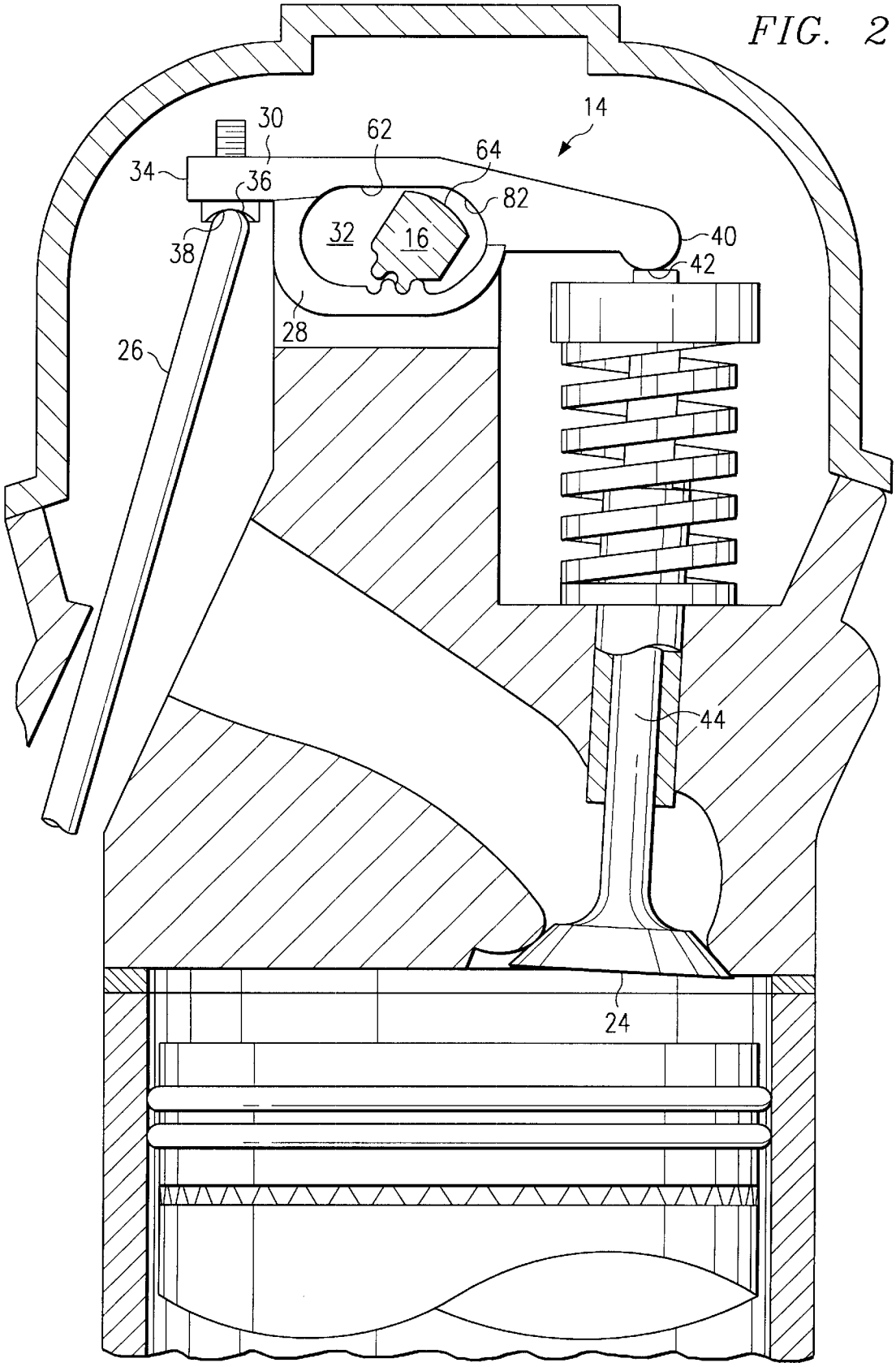
FIG. 2 is a side view of a preferred embodiment of a rocker arm in functional position about the fulcrum, pushrod and valve stem taken along lines 2—2 of FIG. 1.

As shown in FIG. 2, the rocker arm 14 is functionally positioned about the fulcrum rod 16 in order to pivot thereabout to cause opening of a valve 24 in response to linear (upward as shown in the drawings) movement of a pushrod 26 in a customary manner. The rocker arm 14 comprises an inner sleeve 28 of generally rectangular cross-section, the sleeve being press-fitted into and brazed, tack-welded or otherwise permanently fixed to a rocker arm body portion 30. The sleeve 28 defines an elongate through passageway or aperture 32 through the rocker arm by which the rocker arm is pivotally mounted to the fulcrum rod. Of course, the rocker arm could also be formed of a single piece, with an elongate aperture machined or otherwise formed therein.

The body portion 30 includes a first end 34 for engaging the pushrod 26. As shown, the pushrod 26 includes a semi-spherical end 36 which engages a mating semi-spherical receptacle 38 in the rocker arm body portion first end 34. Those skilled in the art will immediately recognize that such mechanical coupling is commonly utilized in conjunction with hydraulically operated valve lifters, there being no mechanical adjustment necessary for efficient opening of the valve 24. Additionally, of course, the present invention contemplates using standard mechanical "solid" valve lifters, in which case a mechanical adjustment, commonly a screw mechanism carried by the rocker arm body portion first end 34, is utilized to effect the necessary mechanical adjustment.

The rocker arm body portion 30 also includes a second end 40 opposite the first end 34, the second end 40 having a valve stem engaging surface 42 for engaging the end of a valve stem 44 of the valve 24. Generally, the end of the valve stem 44 is as flat as possible; therefore, the valve stem engaging surface 42 is slightly arcuate in order that the engagement between the valve stem 44 and the rocker arm 14 will be as much of a surface contact (theoretically a line contact) as is possible, across the entire range of pivot of the rocker arm about the fulcrum rod 16. It is imperative to maintain the surface contact between the rocker arm 14 and the top of the valve stem 44. The instant invention does so in a unique manner, while additionally reducing any side loading on the valve stem created by conventional fulcrum shaft-type rocker arm assemblies.

As shown in FIG. 2, FIG. 4, FIG. 5, FIG. 6, and FIG. 7, the fulcrum rod 16 incorporates a toothed sector formed by a first axial spline 46 and a second axial spline 48 defining a first axial groove 50 and a second axial grove 52 there between. The splines 46, 48 and axial grooves 50, 52 on the fulcrum rod 16 are adapted to engage a toothed rack incorporating a first mating spline 54, a second mating spline 56, a first mating groove 58 and a second mating groove 60 formed in the bottom of the aperture 32 formed in the rocker arm sleeve 28. Those skilled in the art will readily appreciate that the rocker arm and fulcrum rod assembly thus described pivots in a manner different from conventional rocker arm and fulcrum rod assemblies.

Traditionally, the fulcrum point of automatic rocker arms is fixed, thereby keeping valve motion characteristics constant throughout the rpm range. The valve movement is independent of engine speed and load, and does not make any considerations for either. The rocker arm of the present invention varies valve lift as a function of engine rpm, tending toward higher numerical ratios as engine speed and airflow requirements increase correspondingly. The rocker arm of the present invention automatically provides that measure of adjustability based upon predetermined rocker ratios and engine speed.

In this regard, it will be apparent that any contact between the upper inner surface 62 of the rocker arm sleeve aperture 28 and the upper surface 64 of the fulcrum rod 16 will be a sliding contact. As a practical matter, the width (height) of the rocker arm aperture will be slightly greater than the diameter of the fulcrum rod in order to permit thermal expansion thereof without interference. Therefore, there will usually be no actual contact between these surfaces.

Figure 3:
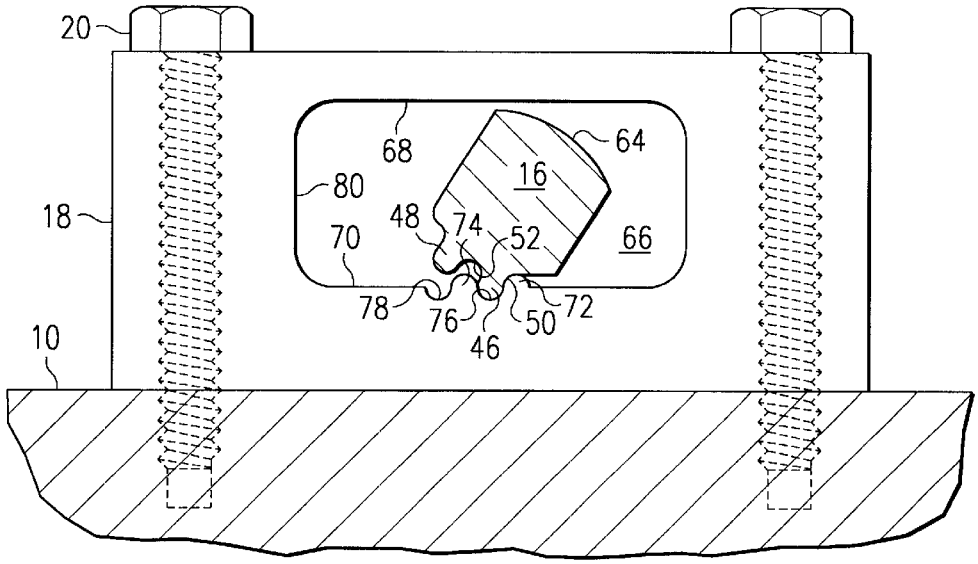
FIG. 3 is a side view of a preferred embodiment of a stationary shaft support of the rocker arm assembly mechanism along lines 3—3 of FIG. 1.

The rocker arm 14 shown in FIG. 2 functions with the stationary shaft support 18 shown in FIG. 3 to retain the fulcrum rod 16 and rocker arm 14 in functional position relative to the valve head 10, the pushrod 26 and valve stem 44. The stationary shaft support 18 includes an aperture there through 66 having an upper inner bearing surface 68 and a lower inner surface 70 defined by a rod seat incorporating a first mating spline 72, a second mating spline 74, a first mating groove 76, and a second mating groove 78 that cooperate with the splines 46, 48 and the grooves 50, 52 on the fulcrum rod 16 to retain the fulcrum rod in one of four functional positions as shown in FIG. 4, FIG. 5, FIG. 6 and FIG. 7. The four functional positions shown in FIG. 4, FIG. 5, FIG. 6 and FIG. 7 will be discussed in greater detail infra.

Those skilled in the art will readily appreciate that the shaft support aperture upper inner surface 68 and the fulcrum rod upper surface 64 are two of the mating load bearing surfaces in the variable ratio rocker arm assembly utilizing the present invention. The these mating surfaces are preferably surface-hardened and highly ground and polished in order to improve the wear characteristics thereof and to decrease any friction between the two surfaces during operation, as will be explained in greater detail hereinbelow.

Regarding the mating load bearing surfaces of the fulcrum rod and rocker arm, referring again to FIG. 2, these load bearing surfaces are defined by the alternate splines and grooves on the lower portion of the fulcrum rod and lower inner surface of the rocker arm sleeve aperture. Therefore, these mating surfaces are additionally surface hardened and highly ground and polished for identical reasons, although, of course, the contact between these latter two mating surfaces is different from that of the former two mating surfaces.

Operation of the Preferred Embodiment

The variable fulcrum rocker arm assembly of the present invention operates similarly to conventional rocker arm assemblies, in that the rocker arm is pivotally mounted on a fulcrum rod for oscillatory pivotal movement in response to reciprocal linear movement of a pushrod to transfer this reciprocal linear movement and resulting force to the valve stem 44 in order to open the valve 24. The fulcrum rod 16 is retained in one of four functional positions relative to the rocker arm by the action of the axial grooves and splines thereon intermeshing with the mating grooves and splines on the shaft support aperture lower inner surface. With the fulcrum rod retained in stationary position relative to the stationary shaft support, the rocker arm pivots about the fulcrum rod in a specified ratio.

Figure 4:
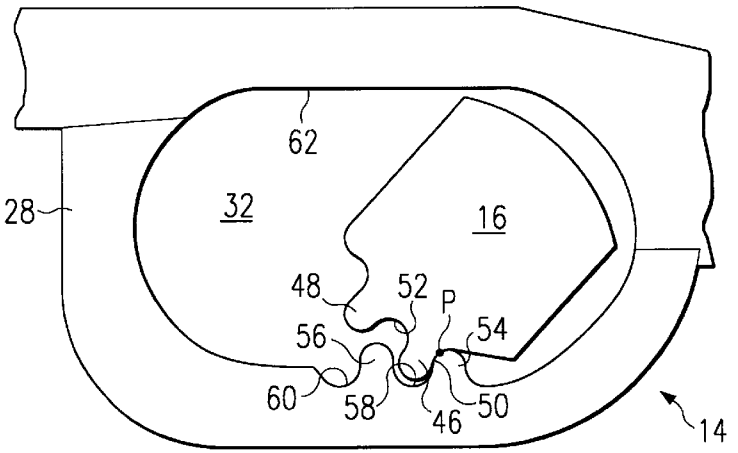
FIG. 4 is a side view of the fulcrum rod engaging the rocker arm in a first engine operating condition.
Figure 5:
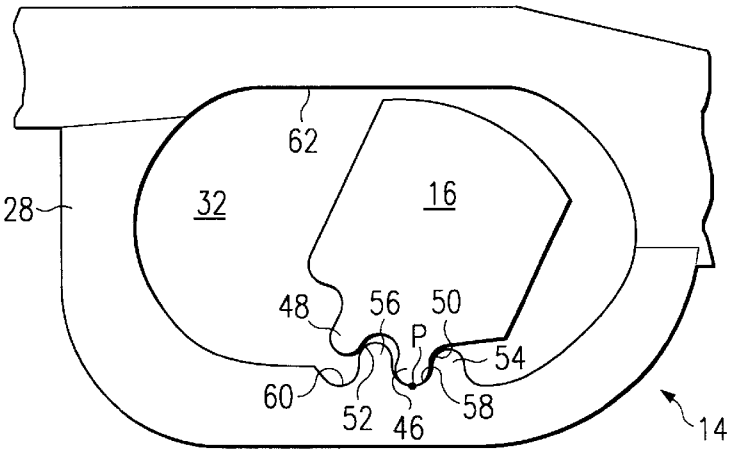
FIG. 5 is a side view of a fulcrum rod engaging the rocker arm in a second engine operating condition.
Figure 6:
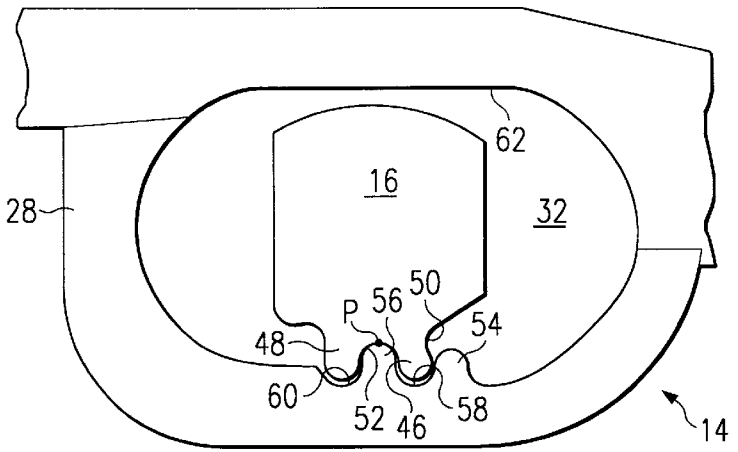
FIG. 6 is a side view of a fulcrum rod engaging the rocker arm in a third engine operating condition; and, FIG. 7 is a side view of a fulcrum rod engaging the rocker arm in a fourth engine operating condition.
Figure 7:
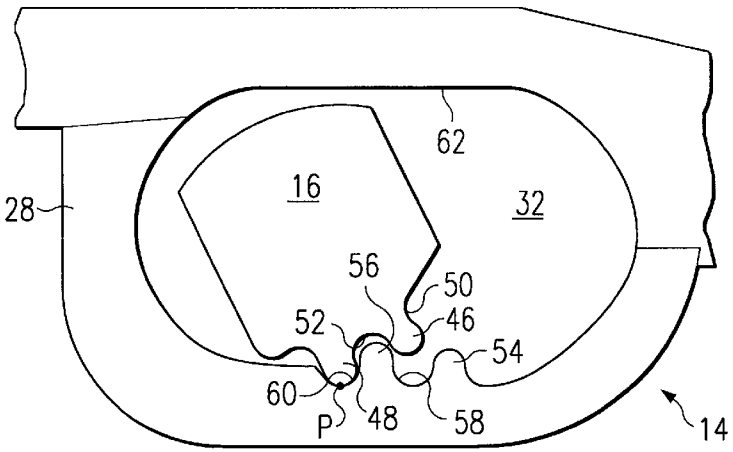

The rocker arm apparatus of the present invention having the fulcrum rod with the first axial spline, the second axial spline, the first axial groove and the second axial groove and the rocker arm having a first mating spline, second mating spline, first mating groove and second mating groove has four possible engine operating conditions or fulcrum pivot points. Referring to FIG. 4, a first engine operating condition corresponds to the pivot point P formed by the first axial groove 50 mating with the first mating spline 54. Referring to FIG. 5, a second engine operating condition corresponds to the pivot point P formed by the first axial spline 46 mating with the first mating groove 58. Referring to FIG. 6, a third engine operating condition corresponds to the pivot point P formed by the second axial groove 52 mating with the second mating spline 56. Referring to FIG. 7, a fourth engine operating condition corresponds to the pivot point P formed by the second axial spline 48 mating with the second mating groove 60.

When it is desirable to increase the amount of valve opening (i.e., increase the reciprocal linear distance that the valve stem 44 travels in response to the force transmitted through the rocker arm, or increase the "rocker arm ratio"), those skilled in the art will readily appreciate that this is easily accomplished by rotating the fulcrum rod in the counterclockwise direction, for example, from the first engine operating condition as viewed in FIG. 4 to the second engine operating condition as viewed in FIG. 5, or from the third engine operating condition as viewed in FIG. 6 to the fourth engine operating condition as viewed in FIG. 7. This counterclockwise rotation of the fulcrum rod is typically accomplished by the fulcrum rod operating lever 22, which is coupled to an actuator controlled by electronics, vacuum, mechanical or hydraulic pressure, etc., to rotate the fulcrum rod in response to certain engine parameter, for example RPMs. Such mechanism for controlling the fulcrum rod operating lever does not constitute a part of the present invention, and therefore will not be discussed in detail herein.

In this manner, it is a simple matter to increase the amount of valve opening in response to increased engine speed or other engine criteria while the engine is in operation, to thereby permit instant increase in fuel/air mixture intake upon demand.

Those skilled in the art will readily appreciate that as the fulcrum rod is rotated in the counterclockwise direction as viewed in FIG. 4, FIG. 5, FIG. 6 and FIG. 7, due to the fact that the stationary shaft support is fixed relative to the valve head, pushrod and valve stem, the effect of rotating the fulcrum rod counterclockwise is to translate the geometric centerline axis of the fulcrum rod in the leftward direction (an example of altering volumetric efficiency).

Similarly, a clockwise rotation of the fulcrum rod has the effect of translating the geometric axis of the fulcrum rod in the rightward direction. It should now be easily seen that with a leftward linear translation of the fulcrum rod centerline axis, the distance between the line of movement of the pushrod 26 relative to the fulcrum rod 16 decrease, and the distance between the line of movement of the valve stem 44 relative to the fulcrum rod 16 correspondingly increases. The combined effect of these two changes in distances is to increase the ratio of moment arms of the valve stem 44 relative to the fulcrum rod pivot point and the pushrod 26 relative to the fulcrum rod pivot point. This, therefore, results in an increase in distance of linear travel of the valve stem for a given constant distance of linear travel of the pushrod 26.

In a similar manner, when engine speed or other criteria reverse or decrease, the sensing mechanism mentioned hereinabove but not described in detail causes rotation of the fulcrum rod in the clockwise direction, effecting a linear translation of the axis thereof in the rightward direction as shown (an example of altering volumetric efficiency, or decreasing the "rocker arm ratio"), for example, from the second engine operating condition as viewed in FIG. 5 to the first engine operating condition as viewed in FIG. 4, or from the fourth engine operating condition as viewed in FIG. 7 to the third engine operating condition as viewed in FIG. 6.

This linear translation in the rightward direction relative to the rocker arm decreases the distance between the line of movement of the valve stem 44 and the fulcrum rod 16, and correspondingly increases the distance between the line of movement of the valve stem 44 and the fulcrum rod 16, thereby decreasing the ratio of these moment arms about the fulcrum rod pivot point. This, therefore, has the effect of decreasing the amount of valve opening for a given constant distance of linear travel of the pushrod. This lesser opening of the valve 24, of course, reduces the intake of fuel/air mixture when high engine torque and power are not necessary, thereby accomplishing the ultimate desired effect of reducing fuel consumption under decreased engine load conditions.

Those skilled in the art should immediately recognize that because one of the moment arms about the fulcrum rod 16 increases simultaneously with a decrease in the other moment arm as the fulcrum rod is rotated, the resulting change in ratio of moment arms may be significant for only a slight or moderate degree of rotation of the fulcrum rod. Therefore, it will be appreciated that only a very slight rotation of the translatable fulcrum rod is required to effect a significant change in the amount of valve opening.

The grooves and splines of the fulcrum rod cooperate with the mating splines and grooves on the stationary shaft support and the rocker arm serve two primary functions: (1) because the splines and grooves fo the fulcrum rod mating with cooperating grooves and splines of the stationary shaft support prevent pure rotation of the fulcrum rod relative to the shaft support aperture lower inner surface, any rotation of the fulcrum rod results in a linear translation of the geometric centerline axis of the rod in a plane parallel to the surface of alternating splines and grooves of the shaft support; and (2) the rocker arm assembly of the present invention provides less valve lift than a conventional cam shaft at speeds below peak power, and at higher RPMs, the rocker assembly of the present invention provides lift beyond the mechanical limits of a conventional camshaft.

It should be noted that the end walls 80 of the shaft support aperture 66 are much closer together than corresponding end walls 82 of the rocker arm aperture 32. In this manner, the amount of lateral translation of the fulcrum rod within the shaft support, and therefore within the rocker arm, may be easily controlled to prevent excessive opening of the valve which would damage the valve and piston head. This additional protection against excessive valve opening is provided for instances wherein the mechanism for controlling the fulcrum rod too far to the left, but for the mechanical stop provided by the left shaft support aperture end wall 80.

Various changes, substitutions and modifications can be realized without departing from the spirit and scope of the invention as defined by the appended claims. For example, two, three, five or more engine operating conditions or rocker arm ratios may be desired. A rocker arm assembly of the present invention with three rocker ratios has a fulcrum rod 16 with a first axial spline, first axial groove and second axial groove and a rocker arm and stationary shaft support with a first mating spline, first mating groove and second mating spline. A first engine operating condition corresponds to the pivot point formed by the first axial groove mating with the first mating spline. A second engine operating condition corresponds to the pivot point formed by the first axial spline mating with the first mating groove. A third engine operating condition corresponds to the pivot point formed by the second axial groove mating with the second mating spline.

What is claimed is:

1. Rocker arm apparatus for use in combination with a push rod and valve stem in an internal combustion engine, said rocker arm apparatus comprising, in combination:

a rocker arm having a first end portion for engaging a push rod, a second end portion for engaging a valve stem, and a toothed rack extending intermediate the first end portion and the second end portion;

a fulcrum rod having a toothed sector and a smooth bearing portion, said toothed sector being disposed in mating engagement with the toothed rack thereby defining a plurality of pivot points providing different pivot ratios, respectively, as the fulcrum rod pivots and moves along the toothed rack, and the rocker arm being spaced from the smooth bearing portion thereby allowing the rocker arm to oscillate freely without contacting the smooth bearing portion;

a stationary shaft support member having a bearing surface disposed for sliding contact engagement against the fulcrum rod bearing portion, said bearing surface opposing movement of the fulcrum rod out of mating engagement with the toothed rack while allowing pivoting movement of the fulcrum rod along the toothed rack; and an operating arm coupled to the fulcrum rod for moving the fulcrum rod along the toothed rack from one pivot point to another.

2. Rocker arm apparatus as recited in claim 1, wherein the toothed sector of the fulcrum rod and the toothed rack of the rocker arm each comprise a plurality of splines separated by one or more axial grooves.

3. Rocker arm apparatus as recited in claim 1, wherein the toothed sector of the fulcrum rod and the toothed rack of the rocker arm each comprise a plurality of splines separated by one or more axial grooves, wherein the splines each have a projection length that is greater than a pocket depth of the axial grooves, thereby providing clearance and allowing free oscillating pivoting movement of the rocker arm relative to the fulcrum rod without interference engagement of adjacent splines against each other.

4. A method of altering valve displacement in an internal combustion engine of the type including a valve stem, a push rod and a rocker arm assembly, comprising the steps:

(a) rotating a fulcrum rod according to an engine operating condition;

(b) releasing a mating engagement between one of the following:

(i) a first spline on the fulcrum rod and a first groove on a rocker arm, wherein the first spline is oversized relative to the depth of the first groove; or (ii) a second groove on the fulcrum rod and a second spline on a rocker arm, wherein the second spline is oversized relative to the depth of the second groove; and (c) forming a mating engagement between one of the following:

(i) a third spline on the fulcrum rod and a third groove on a rocker arm, wherein the third spline is oversized relative to the depth of the third groove; or (ii) a fourth groove on the fulcrum rod and a fourth spline on a rocker arm, wherein the fourth spline is oversized relative to the depth of the fourth groove.

* * * * *